United States Patent [19]

Benson et al.

[11] 4,221,183

[45] Sep. 9, 1980

[54] APPARATUS FOR TREATING STRAND

[75] Inventors: Gustav E. Benson, Newark; Ralph S. Dale, Heath, both of Ohio

[73] Assignee: Owens-Corning Fiberglas Corporation, Toledo, Ohio

[21] Appl. No.: 10,440

[22] Filed: Feb. 8, 1979

[51] Int. Cl.[3] ..... B05C 11/02; B05C 3/02; B05C 3/12

[52] U.S. Cl. ..... 118/125; 28/219; 118/411; 118/420; 118/DIG. 18; 118/DIG. 19

[58] Field of Search ..... 28/1.4, 59, 72.12; 118/DIG. 20, 234, 235, 405, 426, 125, 411, DIG. 18, DIG. 19; 28/219

[56] References Cited

U.S. PATENT DOCUMENTS

| | | | |
|---|---|---|---|
| 2,728,972 | 1/1956 | Drummond et al. | 118/DIG. 20 |
| 3,683,846 | 8/1972 | Flournog et al. | 118/235 X |
| 3,776,183 | 12/1973 | Benson et al. | 118/235 |

*Primary Examiner*—Michael R. Lusignan

*Attorney, Agent, or Firm*—Ronald C. Hudgens; Philip R. Cloutier; Greg Dziegielewski

[57] ABSTRACT

Apparatus is provided for supplying a liquid to an advancing strand comprising: a frame; first actuator means associated with said frame; a first element mounted on said frame, said first element having a port adapted to supply said liquid to said strand; a member mounted on said first element; a second element fastened to said member, said second element being spaced from said first element, said second element having a port adapted to supply said liquid to said strand; a third element journaled at said member, said third element being spaced from said first element and said second element; and second actuator means associated with said first actuator means, said second actuator means being fastened to said third element, said first actuator means and said second actuator means being adapted to move said strand such that said strand does not contact said liquid supplied at said port of said first element when said member is in a first position, said second element being positioned such that said strand does not contact said liquid supplied at said port of said second element when said member is in said first position.

11 Claims, 5 Drawing Figures

APPARATUS FOR TREATING STRAND

BACKGROUND OF THE INVENTION

Bundles of textile filaments, or strands, are treated with a liquid finish or binder for a variety of reasons. It is a practice to collect the wet yarns as a wound package; and with high speed the yarn processing operations, interim yarn collecting systems are employed.

When an aspirator, or a vacuum system, is employed as an interim collection system generally, it is difficult for the system to sufficiently advance a wet yarn. Therefore, it is necessary that the yarn not receive the liquid treatment at such times.

The system shown in U.S. Pat. No. 3,776,183 issued to Benson et al on Dec. 4, 1973, addressed the problems of interim yarn collection and liquid application associated with liquid treated yarns.

SUMMARY OF THE INVENTION

Apparutus is provided for supplying a liquid to an advancing strand comprising; a frame; first actuator means associated with said frame; a first element mounted on said frame, said first element having a port adapted to supply said liquid to said strand; a member mounted on said first element; a second element fastened to said member, said second element being spaced from said first element, said second element having a port adapted to supply said liquid to said strand; a third element journaled at said member, said third element being spaced from said first element and said second element; and second actuator means associated with said first actuator means, said second actuator means being fastened to said third element said first actuator means and said second actuator means being adapted to move said strand such that said strand does not contact said liquid supplied at said port of said first element when said member is in a first position, said second element being positioned such that said strand does not contact said liquid supplied at said port of said second element when said member is in said first position.

It is an object of this invention to provide an improved system for applying a coating to advancing strand.

It is another object of the invention to provide apparatus for applying a liquid to an advancing strand at predetermined periods.

DESCRIPTION OF THE INVENTION

Figure 1:
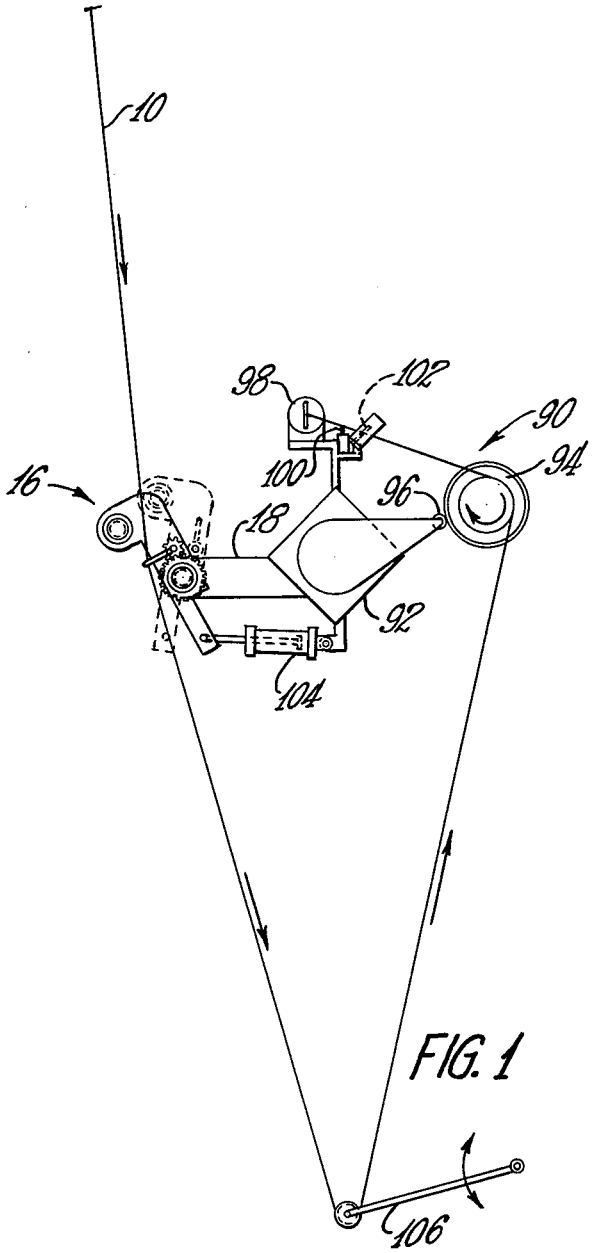
FIG. 1 is a semi-schematic frontal view of the applicator system associated with a winder system according to the principles of this invention.

As shown in FIGS. 1, 2, 4 and 5, strand 10 is advanced along applicator assembly 16 to apply a suitable coating or liquid to the strand 10 at predetermined intervals.

Applicator assembly 16 is comprised of a frame 18 which can be suitably fastened to winder 90. First element 20, which can be a stationary shaft, can be rigidly secured to frame 18. First actuator means, such as gears 22, are rigidly secured to frame 18 by means of fasteners or screws 24.

Member or members 26 can be rotatably mounted on first element 20 at bore or pivot point 28 thereof. At one end, projection 30 extends from bore 28 and is provided with aperture 32 to permit motive means 104 to be coupled therewith. Extension 34 of member 26, opposite projection 30, is provided with aperture 36 to securely accommodate second element 38 therein.

Rotatable, third element 42 is mounted in member 26 and is spaced from first and second elements 20 and 38, which are also in spaced apart relationship relative to each other. Second actuator means, such as rotatable gears 40, are associated with the first actuator means 22 and are rigidly attached to third element 42. The first and second actuator means 22 and 40 are adapted to move or rotate the "Y" shaped fingers 44 of the third element 42 such that the advancing strand does not contact the liquid supplied through the outlet port 54 located in groove 52 of first element 20.

Figure 2:
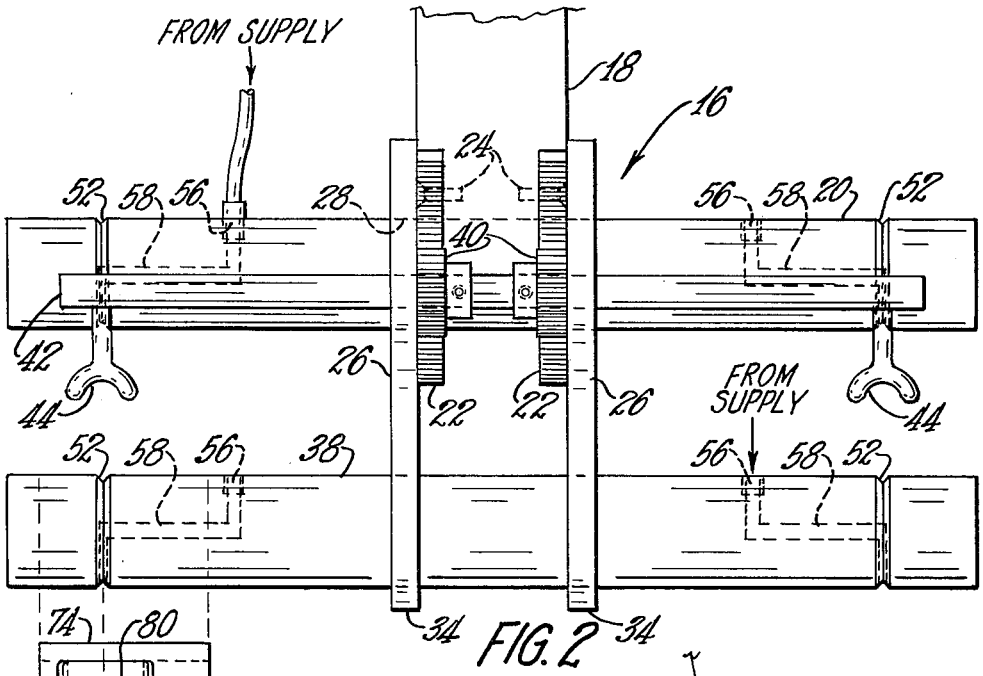
FIG. 2 is a top view of an applicator system similar to that shown in FIG. 1.
Figure 3:
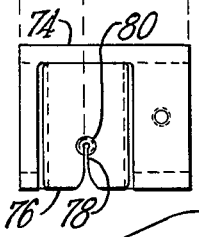
FIG. 3 is a plan view of a wiping dye associated with the applicator system according to the principles of this invention.

The liquid can be supplied by any suitable means such as a flexible hose coupled to a suitable supply pump (not shown) at one end with the other end being suitably connected to the inlet port 56 which is in communication with the outlet port 54 by means of passageway 58 for a single or multi-strand processing as shown in FIG. 2.

Figure 4:
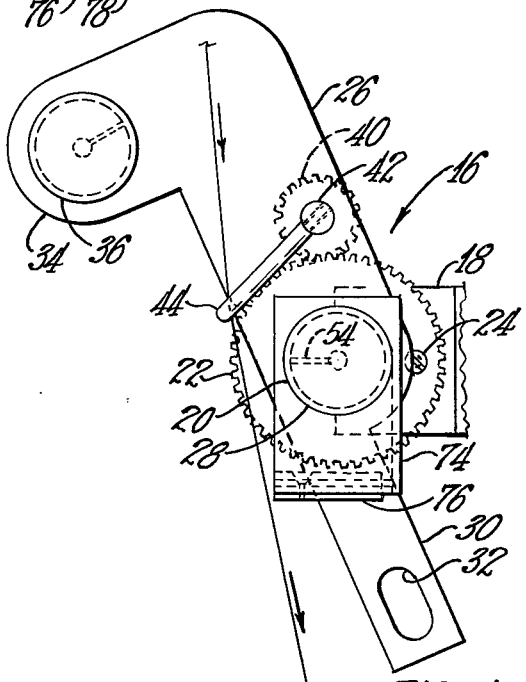
FIG. 4 is a side view of the applicator shown in FIG. 2 in the non-application mode incorporating the wiping dye shown in FIG. 3.

As can be seen in FIG. 4, finger 44 is rotated to move the advancing strand away from outlet port 54 such that the advancing strand does not contact the liquid supplied at port 54 when the member 26 is in a first or liquid non-application position. When member 26 is in the first position, the second element 38 is also positioned such that outlet port 64, located in groove 62 on second element 38, is spaced from the advancing strand such that the liquid supplied at port 64 does not contact the advancing strand.

Similarly, the liquid can be supplied to port 64 by means of the same or another pump that supplies port 54 via flexible hose (not shown) attached to inlet port 66 which is in communication with outlet port 64 by means of passageway 68.

Figure 5:
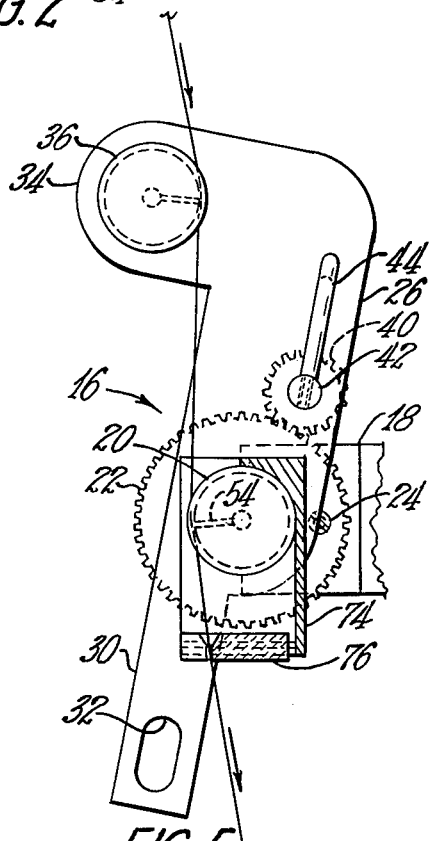
FIG. 5 is the side view of the applicator shown in FIG. 2 in the liquid application mode.

As shown in FIG. 5, outlet ports 54 and 64 of first and second elements 20 and 38, respectively, are positioned at about the points of tangency of said advancing strand 10 with first element 20 and second element 38 when member 26 is in the second or liquid application position.

In some instances, a wiping dye can be positioned downstream of the outlet ports 54 and 64 to work the liquid deeper into the bundle of filaments and to remove excess liquid from the surface of the strand. As such, insert 76, having recess 80 therethrough in communication with the lateral edge of the insert via chamfered slot 78, is located in bracket 74. Bracket 74 is securely attached to first element or shaft 20 by any suitable means.

It is to be understood that the above described system can be modified to accommodate a single or a plurality of advancing strands for a treatment with such liquid. As shown in FIG. 2, a pair of strands one each located adjacent fingers 44, can be treated with the liquid according to the principles of this invention or a plurality of strands can be treated at each of the outlet ports.

At the initiation of strand collection upon winder 90, applicator assembly 16 is in the first mode such that the liquid is not applied to the advancing strand. Winder 90 is comprised of a base 92, a collet 94, and a roller bale 96 adapted to deposit the strand upon the surface of the package as is known in the art. Also included is an aspirator or vacuum system 98 which functions as an interim strand collection system.

Prior to the collection of the strand upon the collet 94, the strand 10 is guided under tension arm 106 of winder 90 and over the collet 94 which is not rotating at such time. The strand passes over an angled knife edge or cutting means adapted to cut the strand as the strand is pulled backwards across the knife edge as it is being wound upon the collet as is known in the art. Located intermediate the aspirator 98 and knife edge 102 is sensing means or limit switch 100 which is adapted to sense the presence of or tension on strand 10.

With the arm of limit switch 100 depressed by the presence of the strand 10, motive means 104, which is suitably attached to base 92 and projection 30, is adapted to position member 26 such that the liquid is not applied to the advancing strand.

Limit switch 100 can be operably interconnected with motive means 104 by conventional electromechanical and/or pneumatic systems.

Once the operator is satisfied that the strand is ready to be wound upon collet 94, the operator activates winder 90 such that collet 94 rotates such that an inwardly biased hook located at the initial strand collection region on collet 94, as is known in the art, extends to capture strand 10 and wrap it thereabout once a predetermined speed for the collet has been attained. At that point, the portion of strand 10 at the aspirator 98 is drawn backwardly across knife edge 102 to sever that portion of strand 10 thus releasing the arm of limit switch 100. Limit switch 100 then energizes motive means 104 to move member 26 such that the liquid is supplied to the advancing strand or strands at ports 54 and 64 which are in an approximate tangential contact therewith.

In another embodiment, first element 20 can be rotatably journaled in frame 18 but rigidly secured to member 26 with first actuator means or gear 22 being rigidly fastened to frame 18. As such, first element or shaft 20 rotates with member 26 as member 26 is moved from the first to second position.

In either embodiment, gear 22 is stationary with second gear 40 being adapted to be in contact therewith and rotate thereabout, functioning as a rack and pinion. In the liquid application position, third element 42 is rotated such that the "Y" shaped finger 44 is moved to a non-strand contacting position as shown in FIG. 5.

It has been found that locating the liquid application ports 54 and 64 at approximately the point at tangential contact between shafts 20 and 38 provides a system wherein the liquid is more effectively forced into the inner sections of the advancing strand. That is, the liquid is forced into the strand to escape the ports 54 and 64 according to such a system.

In treating strands of fibrous glass it is important that the strand contacting portions of the applicator assembly 16 be made of a non-abrading material such as brass and/or micarta and the like.

Also according to the principles of this invention it is possible to apply different liquids to a strand by supplying one liquid to port 54 and another liquid to port 64 which can be connected to suitable pumps.

The pump or pumps employed in the above described systems can be operably inner-connected with limit switch 100 such that the pumps do not actively force liquid out of ports 54 and 64 when the strand is being advanced by means of interim collection means or aspirator 98.

It is apparent within the scope of the invention, modifications and different arrangements can be made other than herein disclosed. The present disclosures are merely illustrative with the invention comprehending all variations thereof.

We claim:

1. Apparatus for supplying a liquid to an advancing strand comprising:

a frame;

first actuator means associated with said frame;

a first element mounted on said frame, said first element having a port adapted to supply said liquid to said strand;

a member mounted on said first element;

a second element fastened to said member, said second element being spaced from said first element, said second element having a port adapted to supply said liquid to said strand;

a third element journaled at said member, said third element being spaced from said first element and said second element; and second actuator means associated with said first actuator means, said second actuator means being fastened to said third element, said first actuator means and said second actuator means being adapted to move said strand such that said strand does not contact said liquid supplied at said port of said first element when said member is in a first position, said second element being positioned such that said strand does not contact said liquid supplied at said port of said second element when said member is in said first position.

2. The apparatus of claim 1 wherein said first element is rotatably mounted in said frame and is rigidly secured to said member.

3. The apparatus of claim 1 wherein said third element is rotatably journaled in said member.

4. The apparatus of claims 1 or 3 wherein said ports of said first element and said port of said second element are positioned at about the point of tangency of said strand with said first element when said member is in a second position.

5. The apparatus of claim 4 further comprising a die means adapted to work the liquid into said strand and remove the excess liquid from said strand.

6. The apparatus of claim 5 wherein said die means is rigidly secured to said first element.

7. The apparatus of claim 1 wherein said first element and said first actuator means are rigidly associated with said frame.

8. The apparatus of claim 7 wherein said member is rotatably journaled on said first element.

9. The apparatus of claim 8 wherein said third element is rotatably journaled in said member and said second actuator means is rigidly fastened to said third element.

10. The apparatus of claims 7, 8, or 9 wherein said port of said first element and said port of said second element are positioned at about the point of tangency of said strand with said first element and said second element when said member is in a second position.

11. The apparatus of claim 10 further comprising a die means adapted to work the liquid into said strand and remove the excess liquid from said strand.

* * * * *